US007905564B2

(12) United States Patent
Sano et al.

(10) Patent No.: US 7,905,564 B2
(45) **Date of Patent: *Mar. 15, 2011**

(54) INK JET PRINTER CAPABLE OF FORMING HIGH DEFINITION IMAGES

(75) Inventors: Eiichi Sano, Itami (JP); Shoichi Minato, Sakai (JP)

(73) Assignee: Minolta Co., Ltd., Osaka-Shi, Osaka (JP)

( * ) Notice: Subject to any disclaimer, the term of this patent is extended or adjusted under 35 U.S.C. 154(b) by 226 days.

This patent is subject to a terminal disclaimer.

(21) Appl. No.: 12/267,969

(22) Filed: Nov. 10, 2008

(65) Prior Publication Data

US 2009/0066744 A1 Mar. 12, 2009

Related U.S. Application Data

(62) Division of application No. 11/730,484, filed on Apr. 2, 2007, now Pat. No. 7,448,713, which is a division of application No. 09/057,502, filed on Apr. 9, 1998, now Pat. No. 7,201,459.

(30) Foreign Application Priority Data

Apr. 10, 1997 (JP) ..... 9-092252

(51) Int. Cl.
*B41J 2/205* (2006.01)

(52) U.S. Cl. ..... 347/15; 347/43

(58) Field of Classification Search ..... 347/5, 14–15, 347/19, 40–43
See application file for complete search history.

(56) References Cited

U.S. PATENT DOCUMENTS

| | | | | |
|---|---|---|---|---|
| 5,146,236 | A | 9/1992 | Hirata et al. | |
| 5,689,291 | A | 11/1997 | Tence et al. | |
| 5,745,131 | A | 4/1998 | Kneezel et al. | |
| 5,980,015 | A | 11/1999 | Saruta | |
| 6,106,093 | A | 8/2000 | Nagoshi et al. | |
| 6,270,199 | B1 | 8/2001 | Kimura et al. | |
| 6,283,571 | B1 | 9/2001 | Zhou et al. | |
| 6,325,492 | B1 | 12/2001 | Koitabashi et al. | |
| 7,532,365 | B2 * | 5/2009 | Asai et al. | 358/3.13 |

FOREIGN PATENT DOCUMENTS

| | | | |
|---|---|---|---|
| JP | 1-235655 | A | 9/1989 |
| JP | 1-235655 | A | 8/2001 |

* cited by examiner

*Primary Examiner* — Thinh H Nguyen
(74) *Attorney, Agent, or Firm* — Buchanan Ingersoll & Rooney PC

(57) ABSTRACT

An ink jet printer ejects ink droplets of a plurality of sizes based on image data, and prints dots of a plurality of sizes corresponding to the ink droplets of the plurality of sizes for recording the image. In the ink jet printer, in order to print a smoothing dot close to a normal dot, pulse voltage having a waveform having its printing timing changed from a waveform for printing the normal dot is applied to a piezoelectric element. As a result, an ink jet printer capable of recording high definition images can be provided.

3 Claims, 17 Drawing Sheets

3

3

INK JET PRINTER CAPABLE OF FORMING HIGH DEFINITION IMAGES

CROSS REFERENCE TO RELATED APPLICATION

This application is a divisional of U.S. application Ser. No. 11/730,484, filed Apr. 2, 2007, which is a divisional of U.S. application Ser. No. 09/057,502, filed Apr. 9, 1998, which claims the benefit of application No. 9-092252 filed in Japan on Apr. 10, 1997, the contents of which are hereby incorporated by reference.

BACKGROUND OF THE INVENTION

Field of the Invention

The present invention relates generally to ink jet printers, and more particularly, to an ink jet printer capable of smoothing images.

There are known some ink jet printers using a piezoelectric element (PZT) for a print head. In such a print head, pulse voltage corresponding to image data is applied to the piezoelectric element, and the piezoelectric element deforms in response to the application of the pulse voltage, which pressurizes ink within a prescribed container (ink channel) and permits ink droplets to be ejected from a nozzle provided at the ink channel toward a recording sheet. An image based on the image data is formed on the recording sheet by the ejected ink droplets.

In the ink jet printer, the amount of liquid to form ink droplets to be ejected is adjusted by causing degree of distortion at the piezoelectric element by changing the amplitude of the pulse voltage applied to the piezoelectric element. Thus adjusting the amount of liquid to form ink droplets, a plurality of dot sizes are available for ink to stick to a recording sheet. Among the plurality of dot sizes, larger dot sizes are used to represent a dark part of an image, and smaller sizes are used to represent a light part of the image.

Meanwhile, in the field of ink jet printers, a smoothing process of virtually improving the resolution of an image and improving a jaggy part of the image at the time of reproducing the image from image data is performed. In the smoothing process, smaller size dots as described above are used.

Referring to FIGS. 29 and 30, the smoothing process will be described. FIG. 29 is a diagram for use in illustration of printing of an image by a normal ink jet printer.

An image printed by the ink jet printer is virtually divided into segments, dots 251 to 254 having a plurality of sizes as described above are printed for printing an image having a density. In the image, the dot center-to-center distance, the distance between the center of a certain dot and the center of an adjacent dot in the four sides is fixed regardless of the size of the dots. In the conventional ink jet printer thus printing images performs the following smoothing process.

FIG. 30 is a diagram for use in illustration of a smoothing process by a conventional ink jet printer.

In the conventional ink jet printer, an image segmented into a lattice is subjected to a smoothing process, in which smaller size smoothing dots 256 are printed around a normal size dot 255.

If, however, smaller size dots are printed in the smoothing process as described above, the dot center-to-center distance may appear to be separated in some printed images. In such an image, the effect of smoothing process deteriorates, in other words, high definition image is not available to the user.

SUMMARY

It is therefore one object of the invention to provide an ink jet printer capable of recording high definition images.

Another object of the invention is to provide a method of controlling printing in an ink jet printer, according to which high definition images can be recorded.

The above-described objects of the invention are achieved by an ink jet printer including the following elements. More specifically, the ink jet printer according to the present invention ejects a plurality of kinds of ink droplets having different sizes depending upon data to be printed, and forms an image on a prescribed recording medium using dots of sizes corresponding to the sizes of the ink droplets. The ink jet printer includes a smoother for smoothing an image using dots smaller than the dots forming the image, and a controller for controlling the smoother to print the smaller dots at positions close to the image forming dots a smaller pitch than the dot pitch of the image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An ink jet printer according to a first embodiment of the invention will be now described in conjunction with the accompanying drawings.

Figure 1:
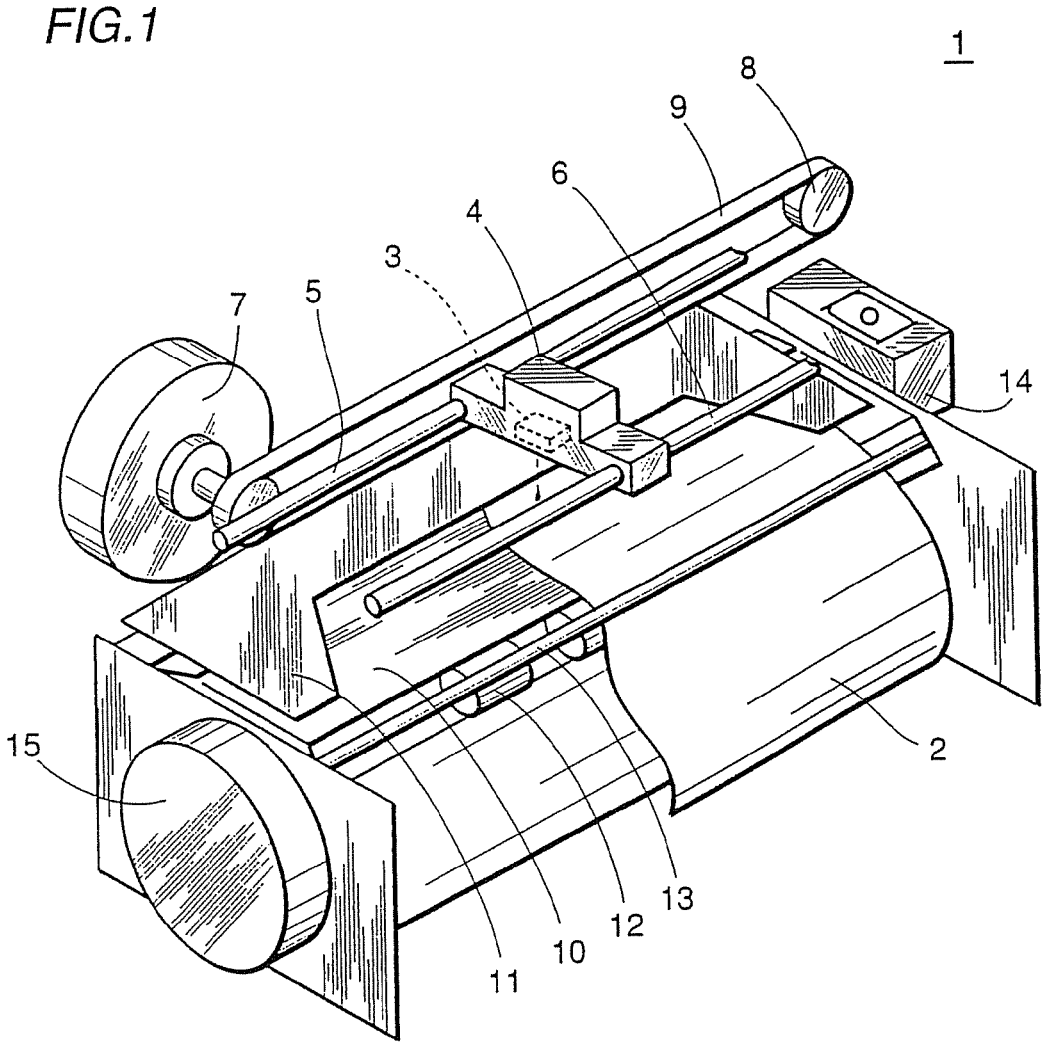
FIG. 1 is a perspective view showing a general structure of an ink jet printer according to a first embodiment of the invention.

Referring to FIG. 1, an ink jet printer 1 includes an ink jet head 3, an ink jet type print head for printing images onto a recording sheet 2, a recording medium such as a paper sheet or OHP sheet, a carriage 4 for carrying ink jet head 3, swinging shafts 5 and 6 for moving carriage 4 back and forth parallel to the recording plane of recording sheet 2, a driving motor 7 for driving carriage 4 to move back and forth along swinging shafts 5 and 6, a timing belt 9 for converting the rotation of driving motor 7 into the reciprocating movement of carriage 4, and an idle pulley 8.

Ink jet printer 1 includes a platen 10 also serving as a guide plate for guiding recording sheet 2 along a transport path, a paper pressing plate 11 for preventing recording sheet 2 between platen 10 and itself from being lifted, a discharge roller 12 for discharging recording sheet 2, a spur roller 13, a regaining system 14 for cleaning the nozzle surface of ink jet head 3 which ejects ink, thereby returning an ink ejection fault to a good state, and a paper feeding knob for manually transporting recording sheet 2.

Recording sheet 2 is fed into a recording unit in which ink jet head 3 and platen 10 oppose each other manually or by a paper feeding device such as a cut sheet feeder which is not shown. At the time, the amount of rotation of a paper feeding roller which is not shown is controlled, so that the transfer into the recording unit is controlled.

A piezoelectric element (PZT) is used in ink jet head 3 as a source of generating energy for ejection of ink. The piezoelectric element is supplied with voltage and distorts. The distortion changes the volume of a channel filled with ink. The change in the volume of the channel allows ink to be ejected from a nozzle provided at the channel, so that recording to recording sheet 2 is performed. Recording sheet 2 is set at a prescribed position and fed in its lengthwise direction.

Carriage 4 scans recording sheet in the width direction corresponding to the main scanning direction by the function of driving motor 7, idle pulley 8 and timing belt 9. Ink jet head 3 attached to carriage 4 records images for one line. Each time data for one line is recorded, recording sheet 2 is fed in the longitudinal direction for sub scanning, and data in the next line is recorded.

Images are thus recorded on recording sheet 2, which is then passed through the recording unit, and discharged by discharge roller 12 provided on the downstream side in the transporting direction and spur roller 13 in contact with roller 12 under prescribed pressure.

Referring to FIGS. 2 to 5, in jet head 3 and its peripheral structure of ink jet head 3 will be now described.

Figure 2:
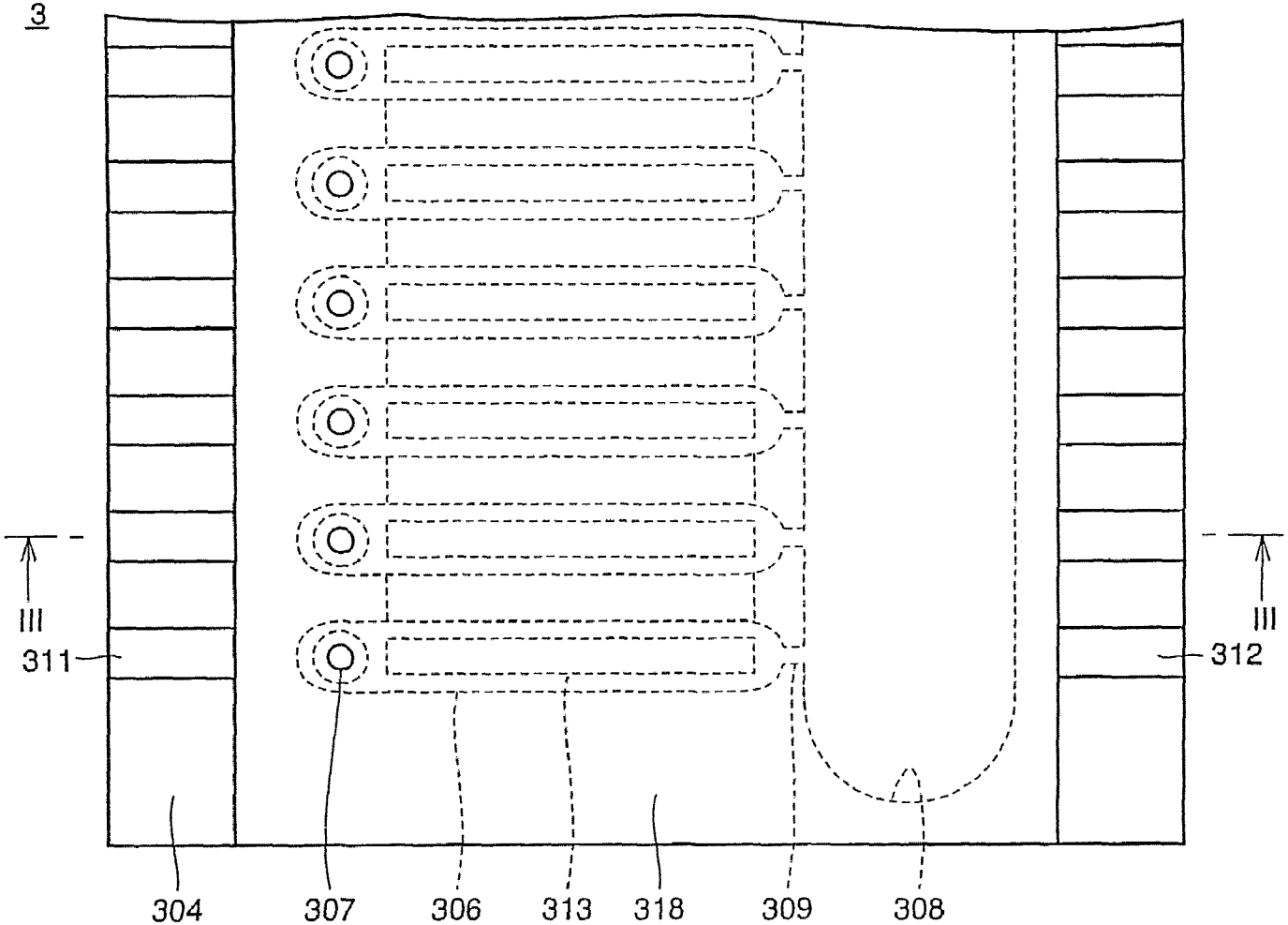
FIG. 2 is a plan view of a plane having nozzles in an ink jet head.
Figure 3:
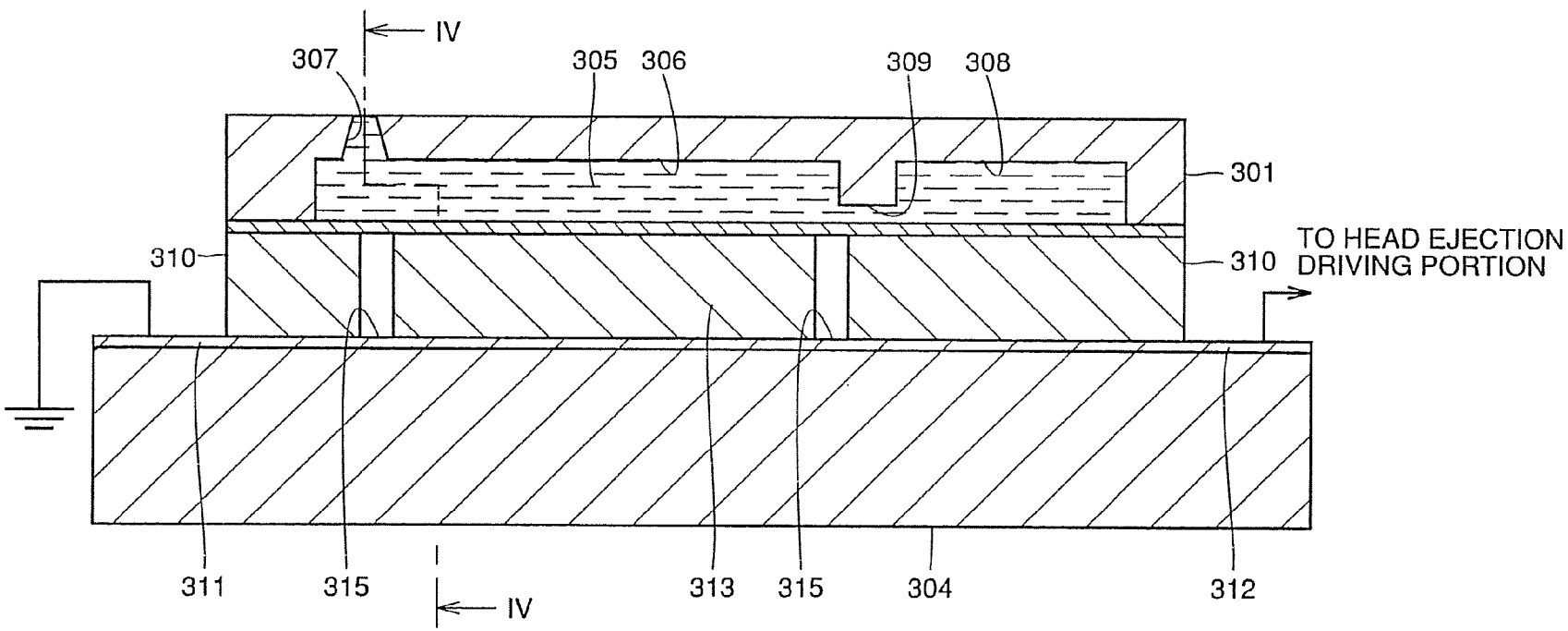
FIG. 3 is a cross sectional view taken along line III-III in FIG. 2.
Figure 4:
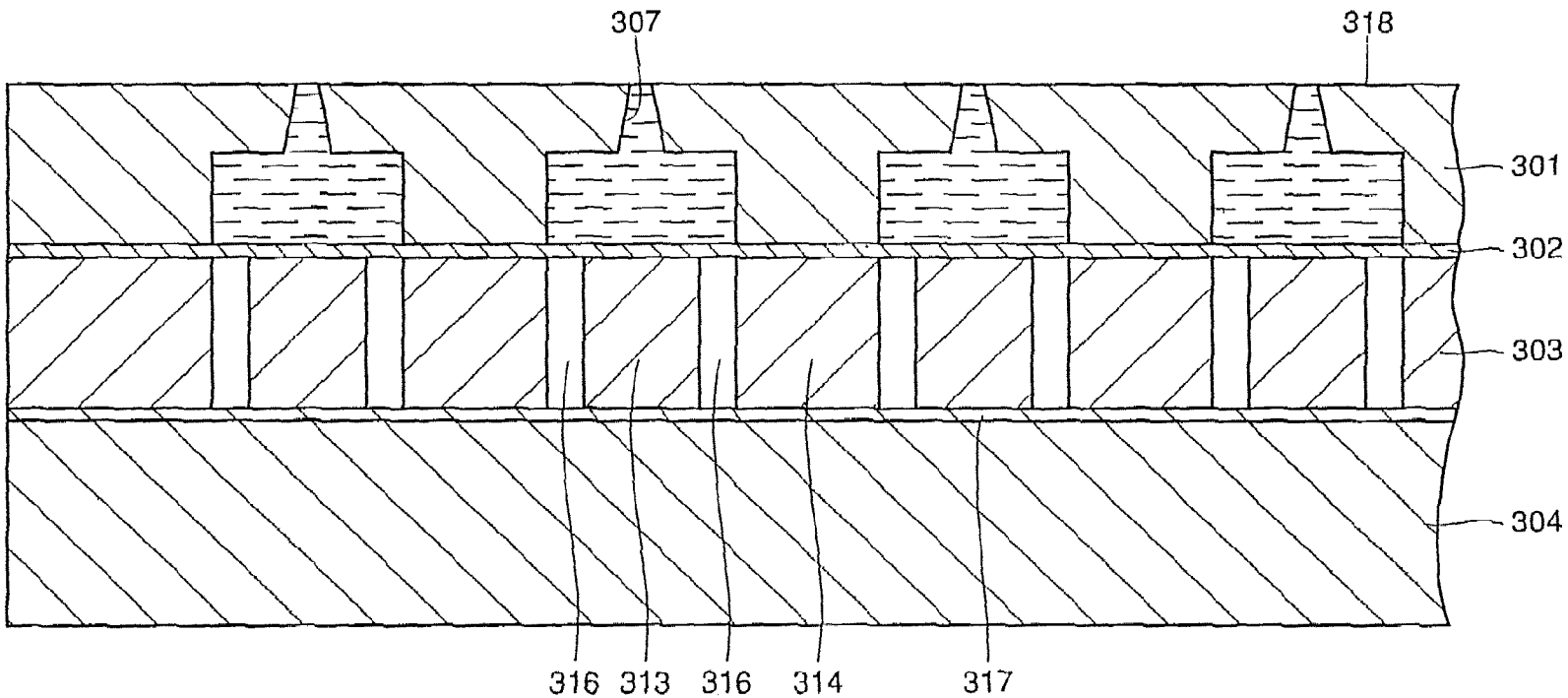
FIG. 4 is a cross sectional view taken along line IV-IV in FIG. 3.

FIGS. 2 to 4 are views for use in illustration of ink jet head 3.

FIG. 2 is a plan view showing a plane having nozzles of ink jet head 3, FIG. 3 is a cross sectional view taken along line III-III in FIG. 2, and FIG. 4 is a cross sectional view taken along line IV-IV in FIG. 3.

Ink jet head 3 is formed by a nozzle plate 301, a partitioning wall 302, a vibrating plate 303, and a substrate 304 which are integrally placed upon each other.

Nozzle plate 301 is formed of a metal or ceramics and has a nozzle 307 and an ink repellent layer on its surface 318. Partitioning wall 302 is formed of a thin film and is fixed between nozzle plate 301 and vibrating plate 303.

There are provided between nozzle plate 301 and partitioning wall 302 a plurality of ink channels 306 for storing ink, and an ink inlet 309 coupling each ink channel 306 to an ink supply chamber 308. Ink supply chamber 308 is connected to an ink tank which is not shown, and ink 305 in ink supply chamber 308 is supplied to ink channels 306.

Vibrating plate 303 includes a plurality of piezoelectric elements 313 corresponding to ink channels 306. Vibrating plate 303 is fixed to substrate 304 having an interconnection portion 317 by an insulating adhesive, and then separate grooves 315 and 316 are formed by dicing to segment vibrating plate 303. By the segmentation, a piezoelectric element 313 corresponding to each ink channel 308, a piezoelectric pillar portion 314 positioned between adjacent piezoelectric elements 313, and a peripheral wall 310 surrounding these elements are separated from each other.

Interconnection portion 317 on substrate 304 has a common electrode side interconnection portion 311 connected to ground and connected commonly to piezoelectric elements 313 in ink jet head 3, and an individual electrode side interconnection portion 312 individually connected to each piezoelectric element 313 in ink jet head 3. Common electrode side interconnection portion 311 on substrate 304 is connected to a common electrode in piezoelectric elements 313, and individual electrode side interconnection portion 312 is connected to an individual electrode in piezoelectric element 313.

The operation of thus structured ink jet head 3 is controlled by a control unit in ink jet printer 1. A printing signal at a prescribed voltage is applied from the ejection driving portion 106 of the control unit (see in FIG. 6) across the region between the common electrode and each individual electrode provided in piezoelectric element 313, and piezoelectric element deforms in the direction pressing partitioning wall 302. The deformation of piezoelectric element 313 is transmitted to partitioning wall 302, which pressurizes ink 305 in ink channel 306, and ink droplets are ejected through nozzle 307 toward recording sheet 2 (see FIG. 1).

Figure 5:
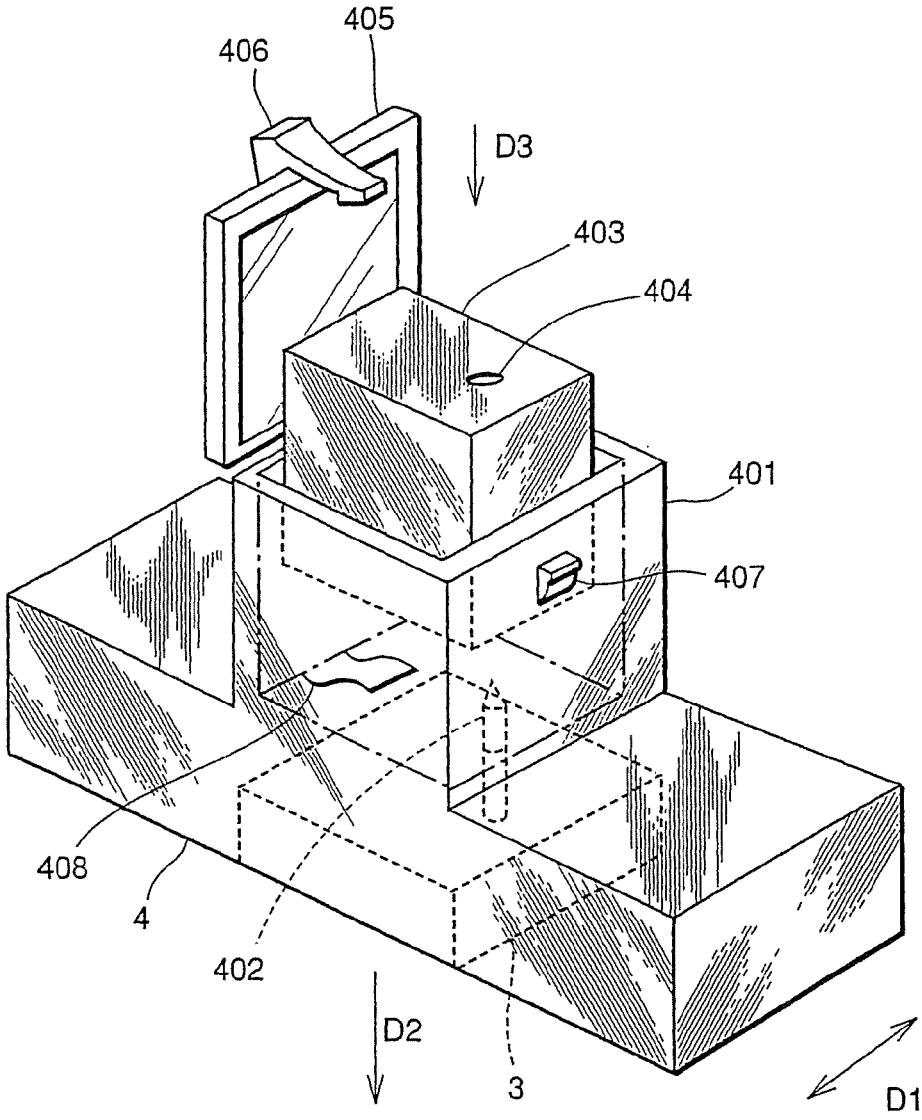
FIG. 5 is a perspective view for use in illustration of the structure of the periphery of a carriage.

FIG. 5 is a perspective view for use in illustration of the structure of the periphery of carriage 4. The periphery of carriage 4 includes an ink cartridge 403 for storing ink and having a ventilation hole 404, a casing 401 for storing ink cartridge 403, a casing lid 405, an ink supply pin 403 for allowing ink cartridge 403 to be detached and supplying ink to ink jet head 3, a clutch 406 for fixing casing lid 405 at casing 401 when casing lid 405 is closed, an energizing clutch stopper 407, and a plate spring 408 for pressing ink cartridge 403 in the opposite direction to the direction of storing ink cartridge 403 (the direction denoted by arrow D3) and retaining cartridge 403 together with casing lid 406. As carriage 4 moves in the direction denoted by D1, a recording sheet is scanned in the main scanning direction, and ink droplets are ejected in the direction denoted by D2.

The ink in ink cartridge 403 includes, as solvent, 80.9% of water, 11.0% of polyhydric alcohol/diethylene glycol, and 2.5% of a viscosity enhancer/polyethylene glycol #400, as a color agent, 4.6% of dye/Bayer BK-SP, and as additive, 0.8% of a surface active agent/olefin E1010, and 0.2% of a pH controlling agent/NaHCO3. Ink 305 having this composition exhibits a surface tension of 36 (dyn/cm) at 25° C., and a viscosity of 2.0 (cp), and a super fine sheet manufactured by the Epson Corporation is used for recording paper (recording sheet 2).

Figure 6:
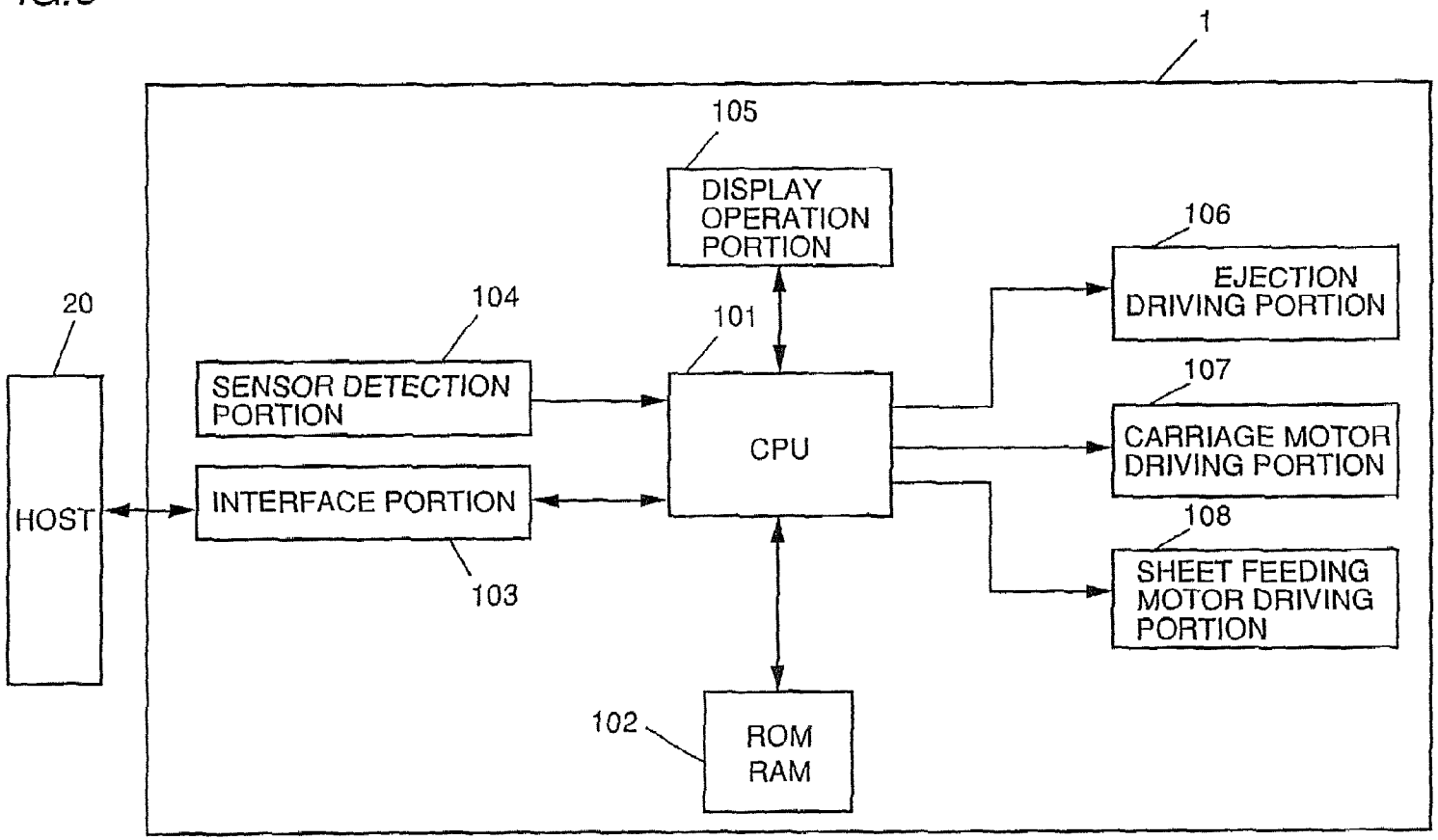
FIG. 6 is a block diagram showing a general configuration of the control unit of the ink jet printer.

Now, the control unit of ink jet printer 1 will be described. FIG. 6 is a block diagram for use in illustration of the configuration of the control unit in ink jet printer 1.

A CPU (Central Processing Unit) 101 in the control unit of ink jet printer 1 is connected to a storage portion 102 including a ROM (Read Only Memory) and a RAM (Random Access Memory), an interface portion 103 connected to a host 20 such as a computer or a word processing machine to exchange data, a sensor detection portion 104, a display operation portion 105, an ejection driving portion 106, a carriage motor driving portion 107, and a sheet feeding motor driving portion 108.

Control programs to control ink jet printer 1 are stored in the ROM in storage portion 102, and the ROM includes a character generator. The RAM in storage portion 102 includes a receiving buffer for temporarily storing data transferred from host 20 and a print buffer for developing the received data into data to be actually printed and temporarily storing the data.

Sensor detection portion 104 includes sensors necessary for detecting the position of the carriage, the temperature and the presence/absence of a recording sheet, and display operation portion 105 includes a display lamp, and various operation switches.

CPU 101 controls the print head, carriage motor and sheet feeding motor through ejection driving portion 106, carriage motor driving portion 107, and sheet feeding motor driving portion 108, respectively based on various input data detection signals and records images on a recording sheet.

Figure 7:
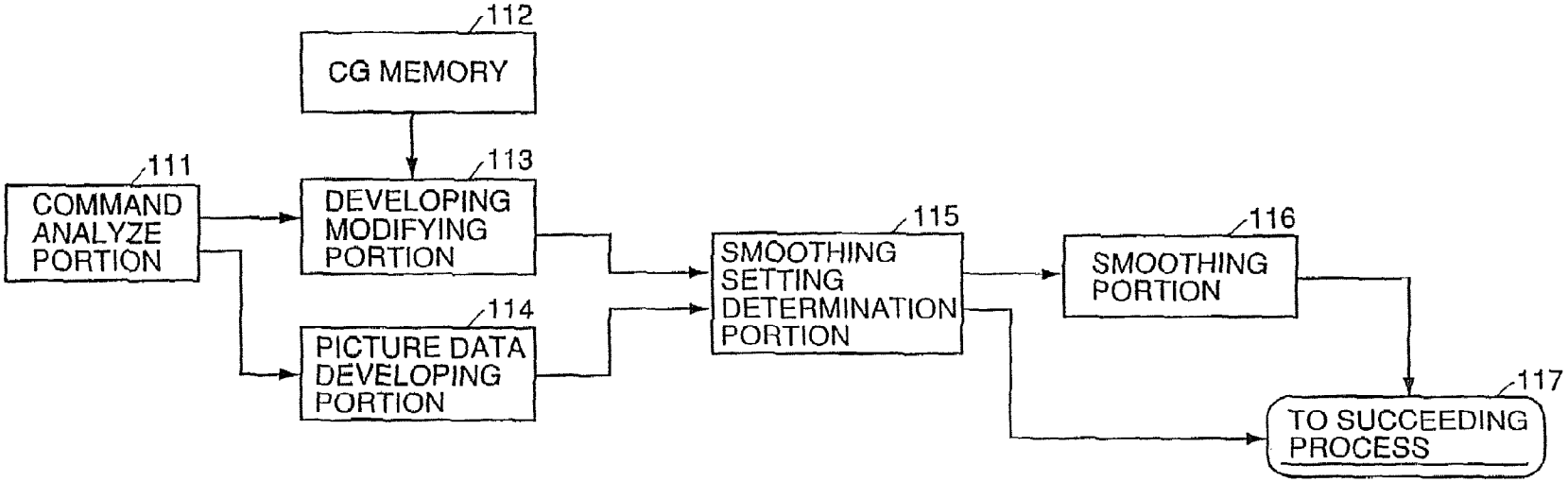
FIG. 7 is a block diagram for use in illustration of the flow of processes performed to image data.

FIG. 7 is a block diagram for use in illustration of the flow of processes performed to image data. These processes are executed by CPU 101 in FIG. 6.

Image data input from host 20 in FIG. 6 is analyzed by a command analyze portion 111. If the input image data is character data, the data is read out from a CG memory 112, and bit map data is developed in the print buffer by a developing modifying portion 113. If the input image data is picture data, the image data is developed in the print buffer by an image data developing processing portion 114.

After the processes, it is determined by a smoothing setting determination portion 115 if a smoothing process is to be performed to the data in the print buffer. If the smoothing process has not been set, the control proceeds to succeeding process 117 without performing a smoothing process to the data in the print buffer, while if a smoothing process has been set, the data in the print buffer is subjected to the smoothing process at smoothing portion 116, and then the control proceeds to succeeding process 117. In succeeding process 117, the image data after the smoothing process is converted into data for driving a piezoelectric element, and ejection driving portion 106 (see FIG. 6) is controlled based on the data to drive the piezoelectric element.

Figure 8:
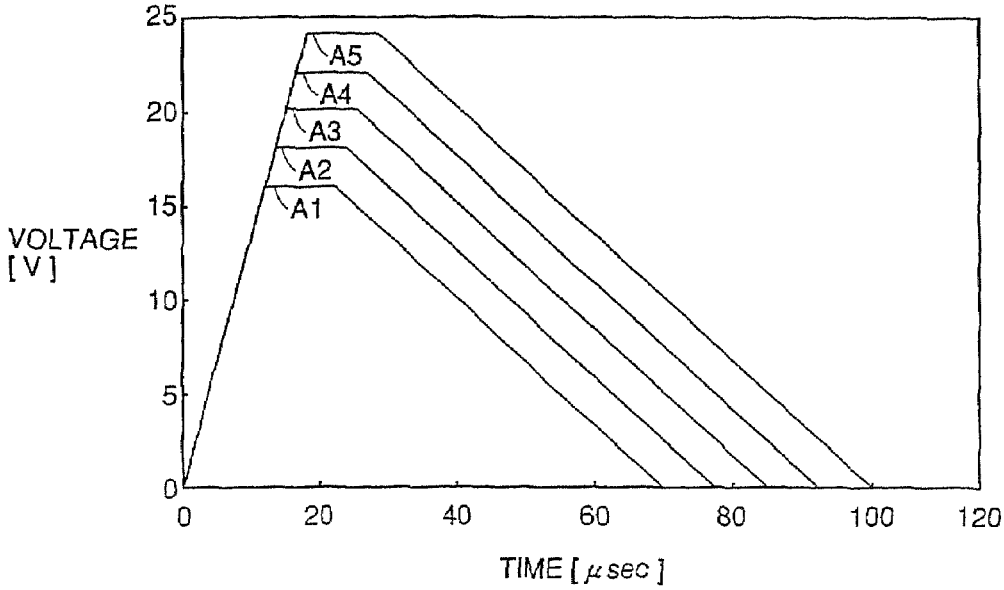
FIG. 8 is a chart showing the waveform of pulse voltage applied from an ejection driving portion for driving a piezoelectric element.

From ejection driving portion 106 in ink jet printer 1 as described above, pulse voltage having a waveform as shown in FIG. 8 is applied to piezoelectric element 313 (see FIGS. 2 to 4).

FIG. 8 is a chart showing the waveform of pulse voltage applied from ejection driving portion 106 to drive the piezoelectric element. Herein, the tone of image to be printed has five tone levels, waveforms start to be applied at the same time point in a graph in which the ordinate represents voltage and the abscissa represents time from the start of application of voltage, and waveforms A1, A2, . . . , and A5 have ascending pulse amplitudes in this order.

Figure 9:
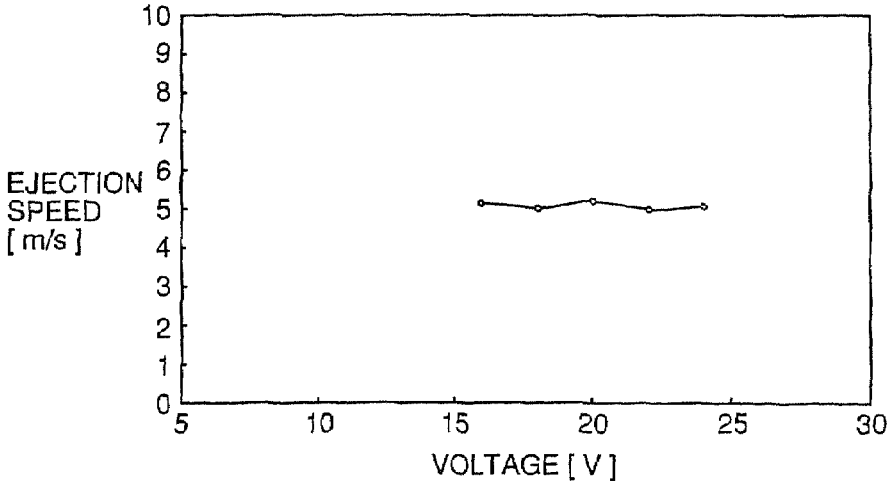
FIG. 9 is a graph showing the speed of ejection of ink droplets ejected by applying the pulse voltage shown in FIG. 8 to a piezoelectric element.
Figure 10:
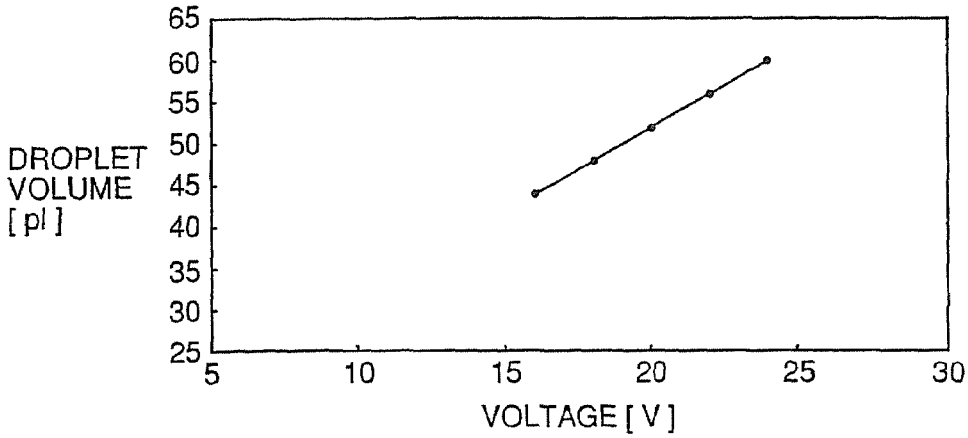
FIG. 10 is a graph showing the volume of ink droplets ejected by application of the pulse voltage shown in FIG. 8 to a piezoelectric element.
Figure 11:
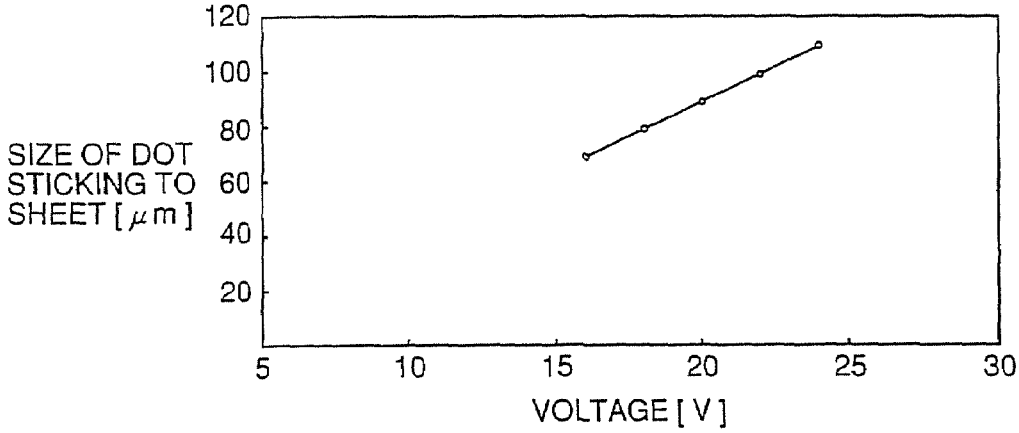
FIG. 11 is a graph showing the size of dots formed by ink droplets ejected by application of the pulse voltage shown in FIG. 8 to a piezoelectric element and sticking to a recording medium.

The results of measuring the speed of ejection of ink droplets, the volume of droplets, and the size of dots sticking to a recording sheet in response to application of pulse voltage having waveforms A1 to A5 to a piezoelectric element are given in FIGS. 9 to 11. The speed of ejection, the droplet volume, and the dot sticking size are average values produced by printing 100 dots, and the ink and the recording sheets used were the same as those described in conjunction with FIG. 5.

FIG. 9 is a graph showing the speed of ejection of ink droplets ejected in response to application of the pulse voltage shown in FIG. 8 to the piezoelectric element, FIG. 10 is a graph showing the volume of ink droplets ejected in response to application of the pulse voltage shown in FIG. 8 to a piezoelectric element, and FIG. 11 is a graph showing the size of dots sticking to a recording sheet formed by ink droplets ejected in response to application of the pulse voltage shown in FIG. 8 to the piezoelectric element. In these figures, the abscissa represents the pulse amplitude of the pulse voltage shown in FIG. 8, and the ordinate represents the speed of ejection of ink droplets, the volume of droplets and the size of sticking dots in response to these pulse amplitudes.

As shown in FIGS. 10 and 11, as the pulse amplitude increases in the pulse voltage having waveforms A1 to A5 in FIG. 8, the volume of corresponding ink droplets and the size of sticking dots both increase. As shown in FIG. 9, the speeds of ejection of ink droplets corresponding to waveforms A1 to A5 are almost fixed at 5 m/s regardless of the size of the ink droplets.

Figure 12:
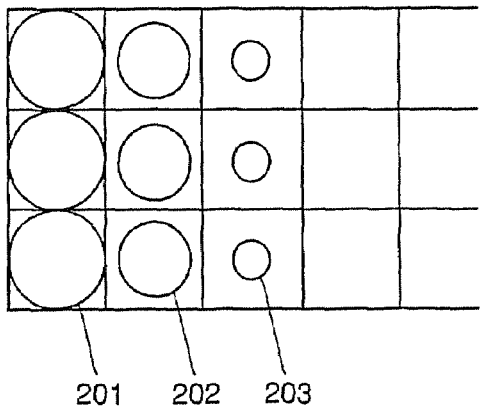
FIG. 12 is a diagram showing examples of dots printed by application of the pulse voltage shown in FIG. 8.

FIG. 12 is a graph showing examples of dots printed in response to application of the pulse voltage shown in FIG. 8.

Dots 201, 202 and 203 having different sizes correspond to waveforms A1, A3 and A5, respectively in FIG. 8 and printed while maintaining the center-to-center distance in the lattice formed by virtual segments on an image at an almost fixed level for scanning at a fixed speed. The center-to-center distance among the different size dots 201, 202 and 203 is maintained at an almost fixed level, because the speed of ejection of corresponding ink droplets, the speed of scanning of the carriage and the driving frequency of the piezoelectric element are maintained at a fixed level.

Figure 13:
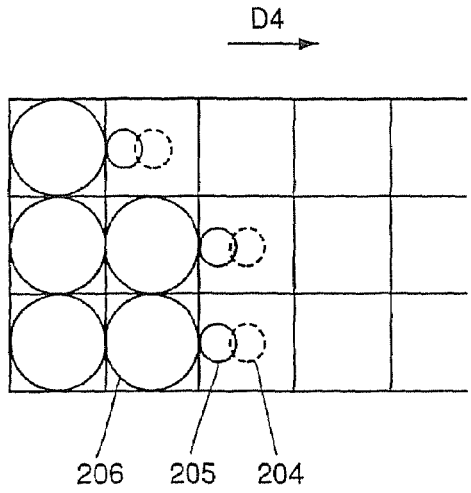
FIGS. 13 and 14 are diagrams for use in illustration of a smoothing process by the ink jet printer according to the first embodiment of the invention.

FIG. 13 is a first diagram for use in illustration of a smoothing process by the ink jet printer according to the first embodiment of the invention. For dot 204 printed in a normal timing (based on a fixed driving frequency of the piezoelectric element), a smoothing dot 205 may be printed closer to dot 206 (at a shorter center-to-center distance) to be smoothed than dot 204 printed in the normal timing by setting earlier the timing of application of voltage to the piezoelectric element. Herein, arrow D4 denotes the direction of scanning.

Figure 14:
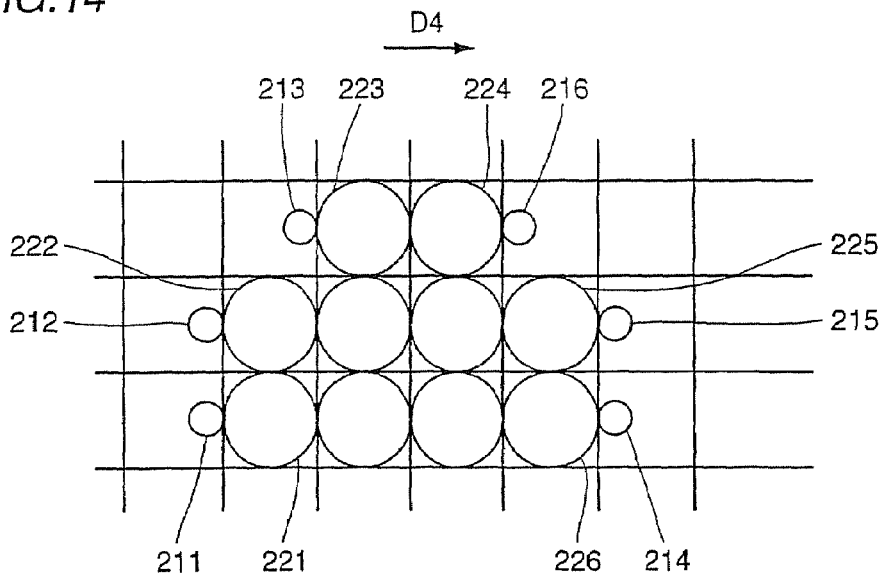

FIG. 14 is a second diagram for use in illustration of the smoothing process by ink jet printer 1 according to the first embodiment of the invention.

Dots 221 to 226 are smoothed using smoothing dots A211 to A213 and smoothing dots B214 to B216. During the smoothing, smoothing dots A211 to A213 are printed in a timing delayed from that of normal dots relative to scanning direction D4, while smoothing dots B214 to B216 are printed in a timing earlier than that of normal dots relative to scanning direction D4. In practice, these timings may be produced as follows.

Figure 15:
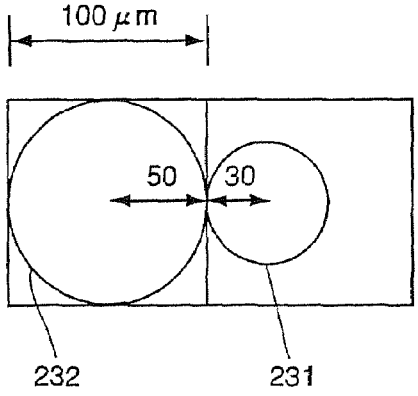
FIG. 15 is a chart for use in illustration of the timing of printing smoothing dots.

FIG. 15 is a chart for use in illustration of the timing of printing smoothing dots. Herein, the size of a dot 232 to be smoothed is 100 μm, the piezoelectric element is driven at a pulse amplitude of 15V when smoothing dot 231 is printed, the size of the smoothing dot is 60 μm, the dot is printed at 250 dpi (at a dot interval of 100 μm) onto a recording sheet, the scanning speed of the carriage is 250 mm/s, and the distance between the nozzle surface of the ink jet head and the recording sheet is 1 mm. In addition, regardless of the size of ink droplets, the speed of ejection of the ink droplets is fixed at 5 m/s.

The center-to-center distance of normal dot is 100 μm, but the center-to-center distance between dot 232 to be smoothed and smoothing dot 231 is set to 80 μm under the above-described condition (at the time, dot 232 and smoothing dot 231 are in contact). The timing of applying pulse voltage to the piezoelectric element which is changed for shortening the center-to-center distance is produced as follows.

If a normal dot is printed without smoothing, the center-to-center distance between dots is 1.00 μm, the scanning speed of the carriage is 250 mm/s, and therefore time until the next dot is printed after a certain dot is printed is produced by the following expression:

$$0.1/250=4\times10^{-4}\ [s]=0.4\ [ms]$$

The driving frequency of the piezoelectric element is produced as 2.5 kHz from the inverse of the time. When a smoothing is performed, the center-to-center distance between dots is 80 μm, and time since a certain dot is printed until a smoothing dot therefor is printed is produced by the following expression:

$$0.08/250=3.2\times10^{-4}\ [s]=0.32\ [ms]$$

From the above two expressions, the following expression is produced:

$$0.4-0.32=0.08\ [ms]$$

By printing a dot in a timing earlier (or delayed) than normal, a smoothing dot having a shorter center-to-center distance to a dot to be smoothed may be printed.

Figure 16:
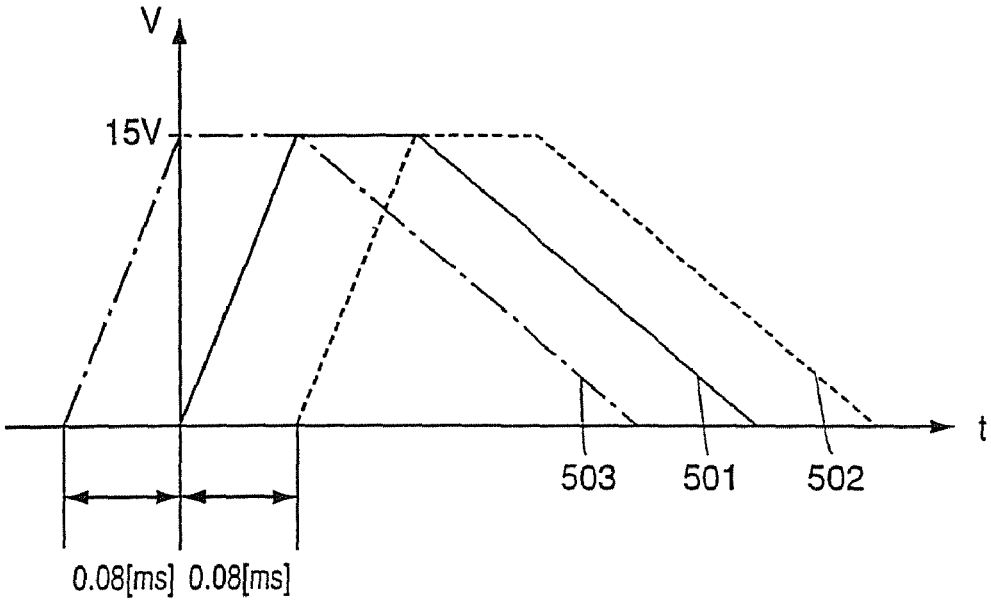
FIG. 16 is a chart for use in illustration of application of pulse voltage to a piezoelectric element for printing smoothing dots by the ink jet printer according to the first embodiment of the invention.

FIG. 16 is a chart for use in illustration of application of pulse voltage to the piezoelectric element for printing a smoothing dot by the ink jet printer according to the first embodiment of the invention.

Waveform 501 is for printing a normal dot 204 in FIG. 13, pulse voltage applied to the piezoelectric element for printing smoothing dots A211 to A213 in FIG. 14 have a waveform 502, and pulse voltage applied to the piezoelectric element for printing smoothing dots B214 to B216 in FIG. 14 have a waveform 503.

In order to select these waveforms 501 to 503, the following control (which corresponds to the process at smoothing determination portion 115 in FIG. 1) is executed by CPU 101 (see FIG. 6).

Figure 17:
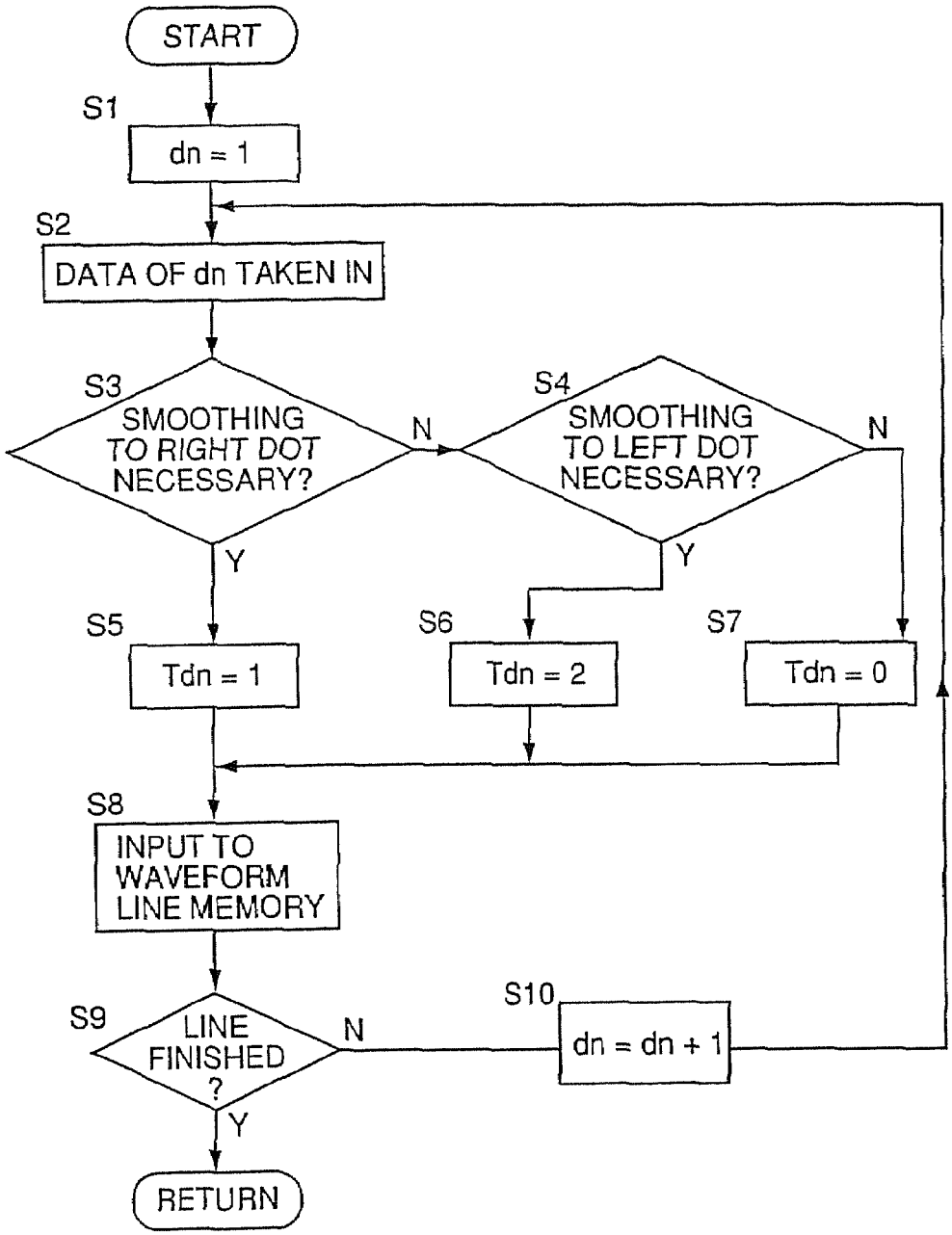
FIG. 17 is a flow chart for use in illustration of the procedure of processes by a smoothing determination portion executed by a CPU 101.

FIG. 17 is a flow chart for use in illustration of the procedure of processes by smoothing determination portion 115 executed by CPU 101.

In S1, a variable dn (the number attached sequentially from an end of a line) for specifying each dot in line n, (a set of linearly arranged dots) in the n-th line forming an image to be printed is set to 1, in other words dn=1. In S2, the data of dots specified by dn is referred to.

In S3 and S4, based on the data of dots corresponding to dn referred to in S2, it is determined if a smoothing to any of adjacent dots is necessary. If it is determined that a smoothing process is necessary to a dot adjacent at the right (YES in S3), a variable Tdn indicating whether a smoothing process is necessary is set to 1 in S5, in other words Tdn=1, while if it is determined that a smoothing process is necessary to a dot adjacent at the left (NO in S3, and YES in S4), Tdn is set to 2, in other words, Tdn=2 in S6. If it is determined that a smoothing process is not necessary (NO in S3 and S4), Tdn is set to 0, in other words Tdn=0 in S7.

When Tdn is substituted by any of 0, 1 and 2, the value of Tdn is stored for each line in a printer buffer A in S8. It is determined in S9 if the n-th line has been finished and if data for 1 line has been stored in the buffer (YES in S9), the routine is completed, while if data for 1 line has not been stored in the buffer (NO in S9), dn is added with 1 in S10 and the processes from S2 are repeated.

The waveform of pulse voltage applied to the piezoelectric element (the timing of applying the pulse voltage) is selected for each dot in each line forming the image to be printed, and stored in printer buffer A for each line. The size of dots to be printed is 60 μm for smoothing dots, and determined based on the result of a tone process such as dither process when dots other than smoothing dots are printed, and data representing the size of dots is stored in a printer buffer B.

The data representing the time of applying pulse voltage stored in printer buffer A and the data representing the size of dots stored in printer buffer B are used for printing.

As described above, during smoothing a dot to be printed, the timing of printing is changed, a smaller size dot is printed close to a dot to be smoothed, and therefore the center-to-center distance between the dot to be smoothed and the smoothing dot will not appear to vary as experienced by the conventional device, so that high definition images may be recorded.

Ink jet printers according to second and third embodiments of the invention will now be described. The ink jet printer according to the second and third embodiments of the invention will be described particularly from viewpoints of difference from the ink jet printer according to the first embodiment of the invention by referring to the drawings, the general structures of the ink jet printer, ink jet head, control unit and the other elements including the procedure of control at the control unit are similar to the ink jet printer according to the first embodiment of the invention.

Figure 18:
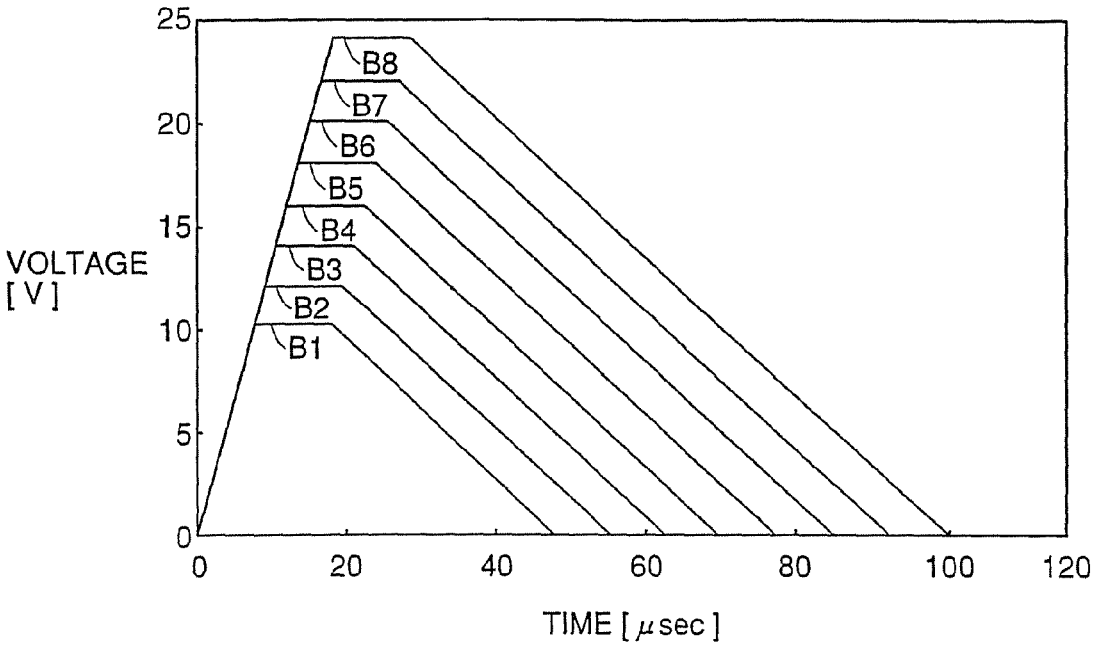
FIG. 18 is a chart showing the waveform of pulse voltage applied to drive a piezoelectric element by an ink jet printer according to a second embodiment of the invention.

FIG. 18 is a chart showing the waveform of pulse voltage applied to drive a piezoelectric element in an ink jet printer according to the second embodiment. Herein, the tone of an image to be printed has eight tone levels. FIG. 18 corresponds to FIG. 8 for the ink jet printer according to the first embodiment. Herein, waveforms B1, B2, . . . and B8 have ascending pulse amplitudes in this order.

Figure 19:
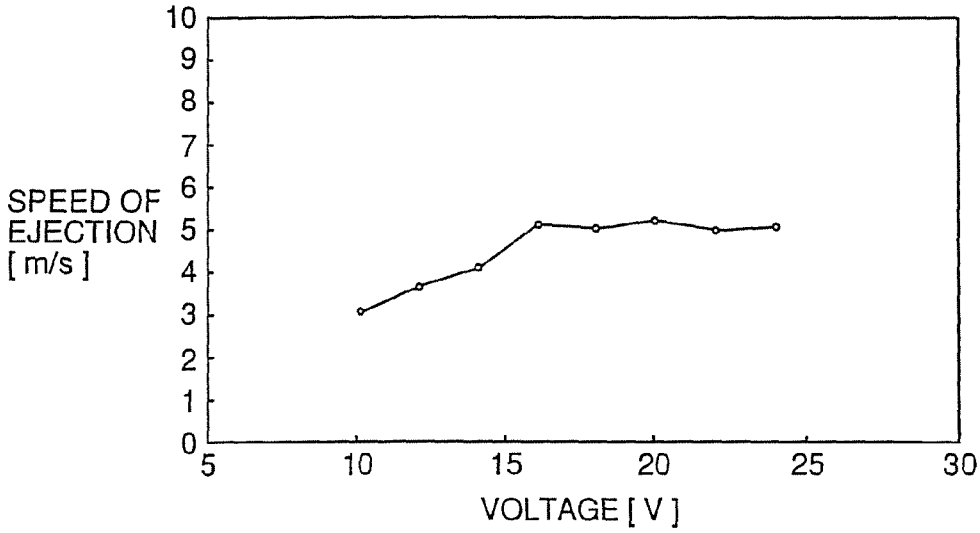
FIG. 19 is a graph showing the speed of ejection of ink droplets by applying the pulse voltage shown in FIG. 18 to a piezoelectric element.
Figure 20:
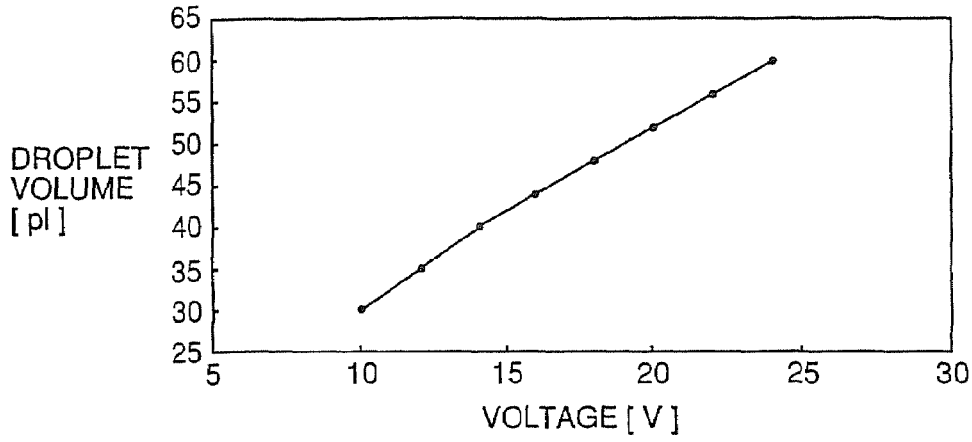
FIG. 20 is a graph showing the volume of ink droplets ejected by application of the pulse voltage shown in FIG. 18 to a piezoelectric element.
Figure 21:
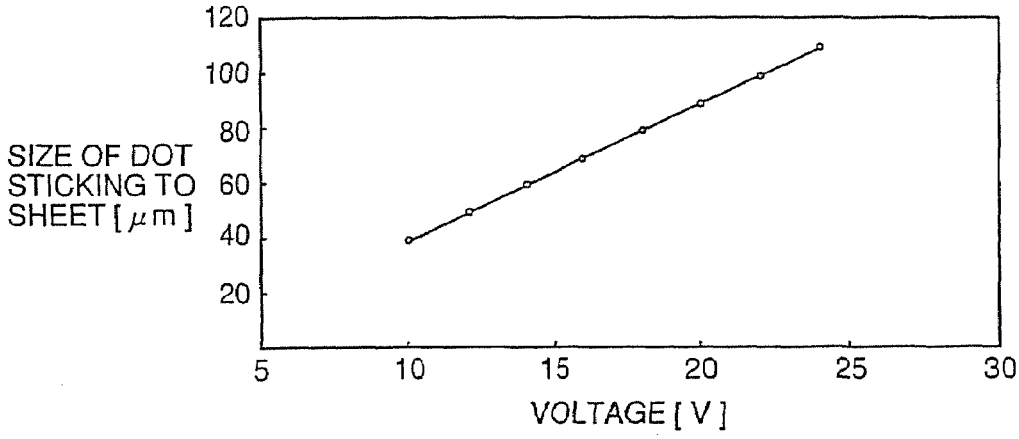
FIG. 21 is a chart showing the size of dots sticking to a recording medium formed by ink droplets ejected by application of the pulse voltage shown in FIG. 18 to a piezoelectric element.

The results of measuring the speed of ejection of ink droplets, the volume of droplets and the size of dots sticking to a recording sheet by applying pulse voltage having waveforms B1 to B8 are given in FIGS. 19 to 21. FIGS. 19 to 21 correspond to FIGS. 9 to 11 for the ink jet printer according to the first embodiment, the measurement condition, and the method of displaying data are the same as those for the ink jet printer according to the first embodiment.

As shown in FIGS. 20 and 21, as the pulse amplitude increases among the pulse voltage having waveforms B1 to B8 in FIG. 18, the volume of corresponding droplets, and the size of corresponding dots both increase. Also as shown in FIG. 19, the speed of ejection of ink droplets corresponding to waveforms B1 to B8 are almost fixed for those corresponding to waveforms B4 to B8, while the ejection speed increases as the pulse amplitude increases for those corresponding to waveforms B1 to B3 having smaller pulse amplitudes and smaller ink droplet sizes. If the ejection speed thus differs, the position of printing is shifted if the piezoelectric element is driven at a fixed driving frequency by a carriage having a fixed scanning speed.

Figure 22:
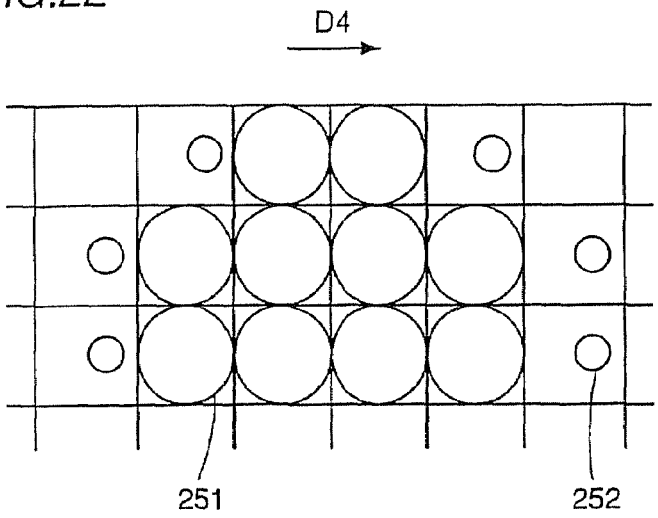
FIG. 22 is a chart for use in illustration of printing of dots shifted in position because of difference in the speed of ejection.

FIG. 22 is a chart for use in illustration of printing of dots shifted in position because of difference in the ejection speed.

If a large size ink droplet, and a small size ink droplet in a different ejection speed from the large size ink droplet are ejected to the scanning direction D4 of the carriage, a large size dot 251 and a small side dot 252 are printed on a recording sheet accordingly, but small size ink droplets take more time to reach the recording sheet than the large size ink droplets, the distance of movement of the carriage in scanning direction D4 is larger. Thus, the center of the small size ink droplet is at a position shifted toward scanning direction D4 from the center of the large size ink droplet in virtual segments in a lattice on the recording sheet.

Thus, if the speed of ejection of ink droplets is different depending on the size of ink droplets, two parameters, in other words the speed of ejection of ink droplets and the speed of scanning of the carriage should be taken into account, in order to change the position of printing a smoothing dot.

Figure 23:
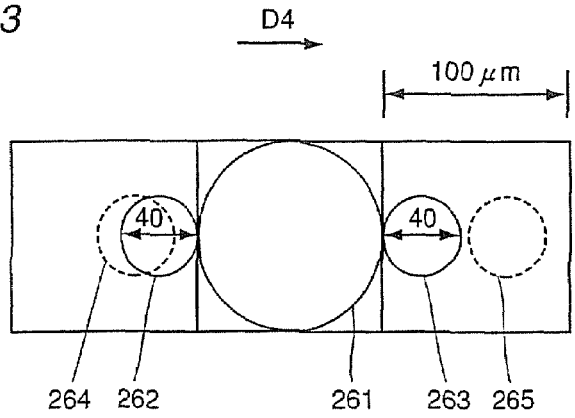
FIG. 23 is a chart for use in illustration of the timing of printing smoothing dots.

FIG. 23 is a chart for use in illustration of the timing of printing of a smoothing dot. A dot 261 is smoothed by a smoothing dot C262 and a smoothing dot D263, the corresponding ink droplets of which have smaller size and smaller ejection speed. Dots 264 and 265 are dots printed in a normal timing (based on a fixed driving frequency of the piezoelectric element which is the same as that for printing dot 261).

During smoothing such dot 261, smoothing dot C262 is printed in a timing delayed from the timing of printing dot 264 in scanning direction D4, and smoothing dot D263 is printed in a timing earlier than that of printing dot 265 in scanning direction D4. In practice, these timings may be produced as follows:

Herein, the size of dot 261 to be smoothed is 100 μm, the size of smoothing dots 262 and 263 is 40 μm, the dots are printed at 250 dpi (the dot distance is 100 μm) on a recording sheet, and the distance between the nozzle surface of the ink jet head and the recording sheet is 0.5 mm. The speed of ejection of ink droplets for printing smoothing dots 262 and 263 (dots 264 and 265) is 3 m/s. The scanning speed of the carriage is 250 mm/s the same as that of the ink jet printer according to the first embodiment, and the driving frequency of the piezoelectric element is 2.5 kHz.

The moving distance of an ink droplet corresponding to dot 261 in scanning direction D4 until the ink droplet reaches a recording sheet from the nozzle surface of the ink jet head is given as follows:

$$250\times(0.5/5000)=0.025\ [\text{mm}]$$

The moving distance of ink droplets corresponding to dots 264 and 265 in the scanning direction until the ink droplets reach a recording sheet from the nozzle surface of the ink jet head is given as follows:

$$250\times(0.5/3000)\approx0.042\ [\text{mm}]$$

As a result, it is understood that the center of dots 264 and 265 are printed shifted from the center of segments in a lattice by the following amount in scanning direction D4:

$$0.042-0.025=0.017\ [\text{mm}]$$

In order to print dot 262, the dot must be moved in scanning direction D4 more than dot 264 by the following amount:

$$30-17=13\ [\mu\text{m}]$$

As a result, the dot must be printed in a timing delayed by the following amount from the normal timing.

$$0.013/250=5.2\times10^{-5}\ [\text{s}]\approx0.05\ [\text{ms}]$$

In order to print dot 263, the dot must be moved in a direction opposite to scanning direction D4 from dot 265 by the following amount:

$$17+30=47\ [\mu\text{m}]$$

Therefore, the dot must be printed in a timing earlier than the normal timing by the following amount:

$$0.047/250=1.9\times10^{-4}\ [\text{s}]\approx0.19\ [\text{ms}]$$

By changing the printing timings as described above, a smoothing dot having a shorter center-to-center distance to a dot to be smoothed may be printed.

Figure 24:
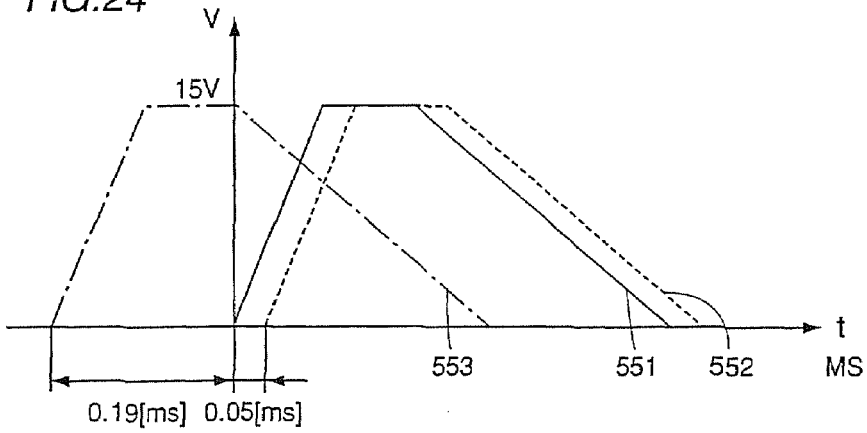
FIG. 24 is a chart for use in illustration of application of pulse voltage to a piezoelectric element for printing smoothing dots by the ink jet printer according to the second embodiment of the invention.

FIG. 24 is a chart for use in illustration of application of pulse voltage to the piezoelectric element to print smoothing dots by the ink jet printer according to the second embodiment.

Waveform 551 is for printing normal dots 264 and 265 in FIG. 23, pulse voltage applied to the piezoelectric element to print a smoothing dot C262 in FIG. 23 has a waveform 552, and pulse voltage applied to the piezoelectric element to print a smoothing dot D263 in FIG. 23 has a waveform 553.

Note that in the case of the ink jet printer according to the second embodiment, the speed of ejection changes depending upon the size of the smoothing dot, and therefore the timing of application of the pulse voltage to the piezoelectric element should be changed depending upon the speed of ejection as follows. A table of dot sizes and ejection speeds is provided in smoothing portion 116 (see FIG. 7), and the timing of printing may be changed according to the table.

As in the foregoing, during smoothing a dot to be printed, the timing of printing is changed, and smaller size dots are printed close to the dot to be smoothed, so that the center-to-center distance between the dot to be smoothed and the smoothing dot will not appear to vary as experienced by the conventional device, and therefore high definition images may be recorded.

Figure 25:
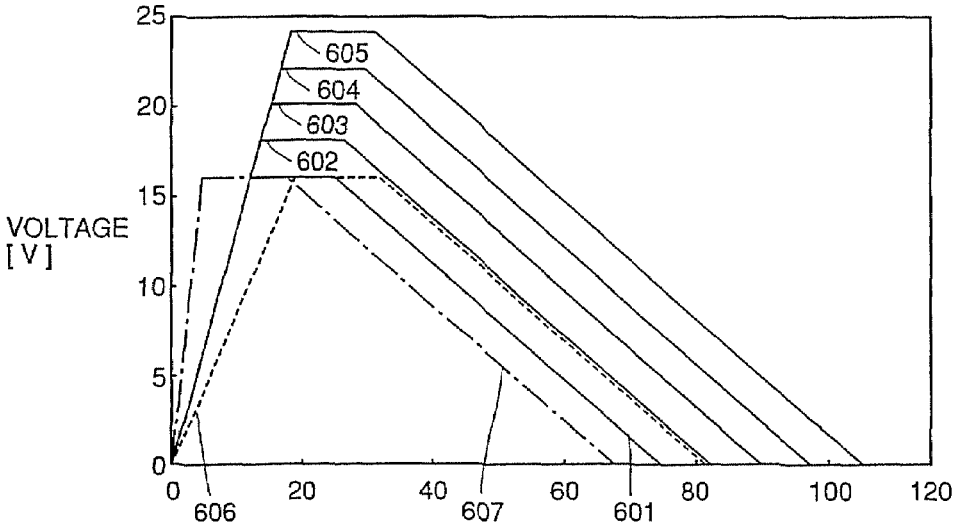
FIG. 25 is a chart showing the waveform of pulse voltage applied to drive a piezoelectric element in an ink jet printer according to a third embodiment of the invention.

FIG. 25 is a chart showing the waveform of pulse voltage applied to drive a piezoelectric element by an ink jet printer according to a third embodiment of the invention. Herein, the tone of an image to be printed has five tone levels as is the case with the ink jet printer according to the first embodiment, and the effect of smoothing and an image to be printed by smoothing are similar to those shown in FIGS. 13 and 14. Waveforms 601 to 605 have ascending pulse amplitudes in this order, and the waveforms of pulse voltage corresponding to smoothing dots are waveforms 606 and 607.

It is clear from experiments that the speed of ejection of ink droplets increases as voltage raised per unit time is larger. The speed of ejection of an ink droplet according to waveform 606 is set lower than the speed of ejection of an ink droplet according to waveform 601, and the speed of ejection of an ink droplet according to waveform 607 is higher than the speed of ejection of an ink droplet according to waveform 601.

Thus, the ejection speed is set lower than normal, smoothing dots 211 to 213 as shown in FIG. 14 having their centers shifted in scanning direction D4 relative to a dot to be printed (dot 204 in FIG. 13) may be printed by applying pulse voltage having normal waveform 601 to the piezoelectric element. Also thus setting higher the ejection speed than normal, smoothing dots 214 to 216 as shown in FIG. 14 having their centers shifted in a direction opposite to scanning direction D4 relative to a dot to be printed by applying pulse voltage having normal waveform 601 as shown in FIG. 25 to the piezoelectric element result.

Figure 26:
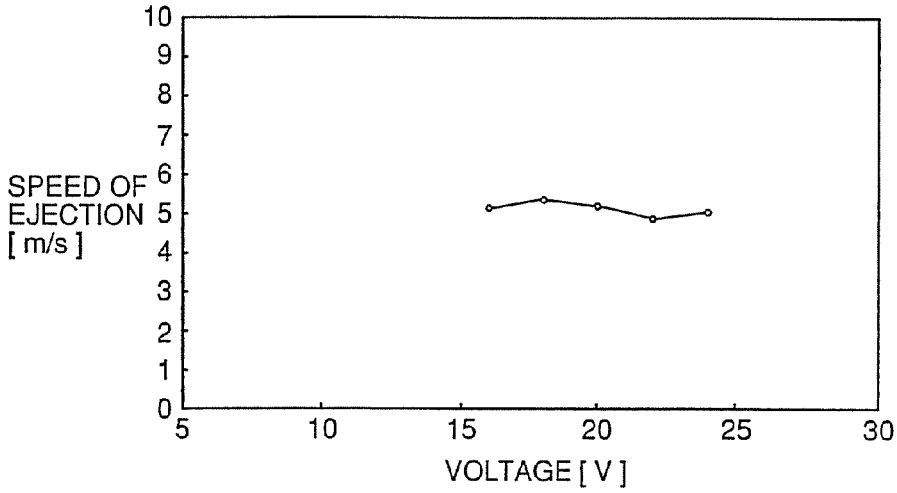
FIG. 26 is a graph showing the speed of ejection of ink droplets ejected by applying the pulse voltage shown in FIG. 25 to a piezoelectric element.
Figure 27:
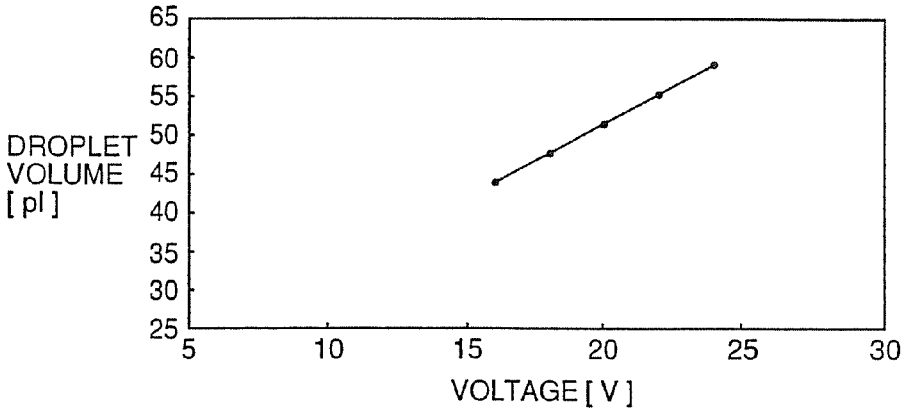
FIG. 27 is a graph showing the volume of ink droplets ejected by applying the pulse voltage shown in FIG. 25 to a piezoelectric element.
Figure 28:
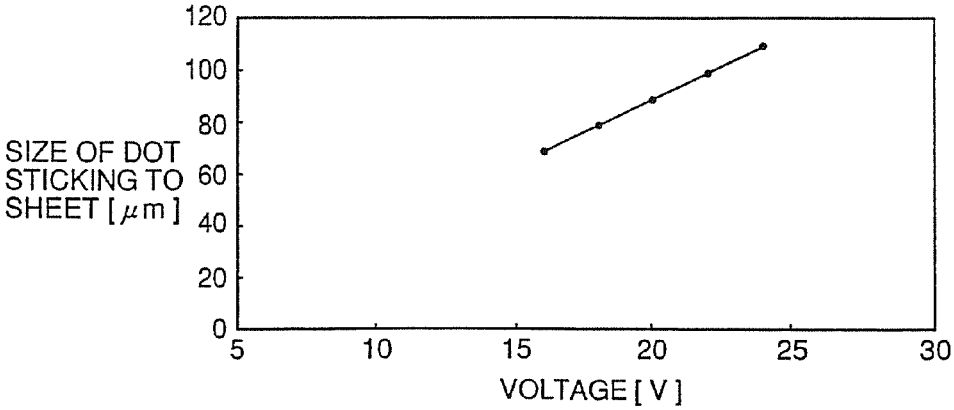
FIG. 28 is a chart showing the size of dots sticking to a recording medium formed by ink droplets ejected by application of the pulse voltage shown in FIG. 25 to a piezoelectric element.
Figure 29:
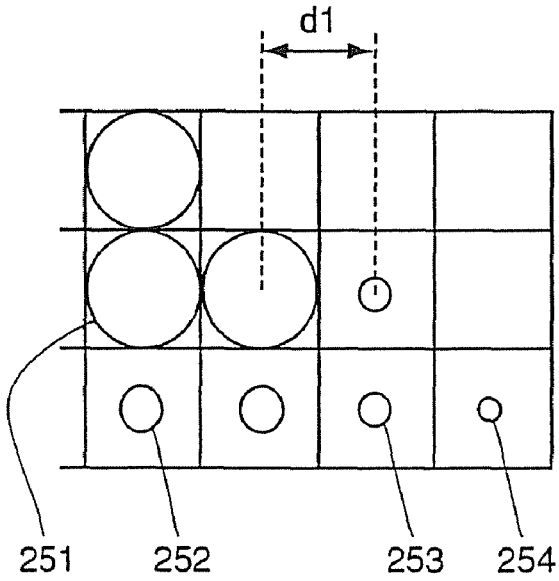
FIG.29 PRIOR ART
FIG. 29 is a diagram for use in illustration of printing of images by a normal ink jet printer.
Figure 30:
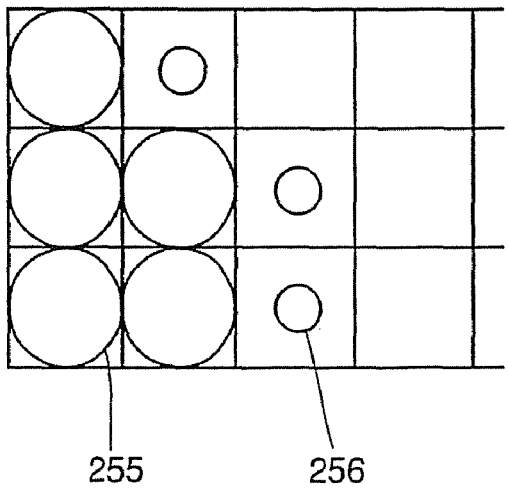
FIG.30 PRIOR ART
FIG. 30 is a graph for use in illustration of a smoothing process by a conventional ink jet printer.

The results of measuring the speed of ejection of ink droplets, the volume of the droplets, and the size of dots sticking to a recording sheet by applying pulse voltage having waveforms 601 to 605 to the piezoelectric element are given in FIGS. 26 to 28. FIGS. 26 to 28 correspond to FIGS. 9 to 11 for the ink jet printer according to the first embodiment of the invention, and the measuring condition, and the way of displaying data are the same as those for the ink jet printer according to the first embodiment.

As shown in FIGS. 27 and 28, as the pulse amplitude increases in pulse voltage having waveforms 601 to 605 shown in FIG. 25, the volume of corresponding ink droplets and the size of corresponding dots both increase. As shown in FIG. 26, the speeds of ejection of ink droplets corresponding to waveforms 601 to 605 are almost fixed at 5 m/s regardless of the size of ink droplets.

As in the foregoing, during smoothing a dot to be printed, the speed of ejection of corresponding ink droplets are changed, smaller size dots are printed close to the dot to be smoothed, so that the center-to-center distance between the dot to be smoothed and the smoothing dot will not appear to be separated as experienced by the conventional device, and high definition images can be recorded.

It is understood that, in the case without a smoothing process, if the speed of ejection of ink droplets changes depending upon the piezoelectric element, the two parameters, the speed of ejection of ink droplets and the scanning speed may be taken into account as is the case with the ink jet printer according to the second embodiment, and dots may be printed at appropriate positions.

In the foregoing, the embodiment is described with reference to a single integrated printer. However, the present invention is not limited to the foregoing but applicable to the ink jet printing device used as a recording portion of a copying machine, a facsimile and so on.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet printer ejecting a plurality of kinds of ink droplets of different sizes from a single nozzle depending upon data to be printed, thereby forming an image on a prescribed recording medium using dots of sizes corresponding to the sizes of the ink droplets, comprising:

an ink jet head for ejecting a plurality of ink droplets, including an image forming droplet and a smoothing droplet, a single nozzle based on data to be printed, the smoothing droplet being smaller than the image forming droplet, thereby printing dots of sizes corresponding to the sizes of the ink droplets on a prescribed recording medium;

a smoother for performing a smoothing process using the smoothing droplet to form a smoothing dot, wherein the distance between a center of the smoothing dot and a center of the image forming dot is smaller than the pitch of the image forming dot, and a controller for controlling the smoother, thereby changing the speed of ejection of the ink droplet forming the smoothing dot in accordance with the size of the ink droplet forming the smoothing dot and not changing the timing of ejection of the ink droplet forming the smoothing dot;

wherein a position where the center of the smoothing dot is to be printed is changed within one of pixel areas arranged in a matrix form for printing dots therein.

2. The ink jet printer as recited in claim 1, wherein said nozzle moves along the recording medium during a printing operation, and said distance between the center of the smoothing dot and the center of the image forming dot adjacent to said smoothing dot is controlled based on the ejection speed of the ink droplet forming the smoothing dot and the moving speed of the nozzle.

3. The ink jet printer of claim 1, wherein the smoothing droplets and image forming droplets are ejected from the single nozzle during a single scan.

* * * * *